US006761940B2

(12) United States Patent
Kammerer et al.

(10) Patent No.: US 6,761,940 B2
(45) Date of Patent: Jul. 13, 2004

(54) PRINTED WEB-TYPE MATERIAL

(75) Inventors: Hans Hermann Kammerer, Weiden (DE); Bernhard Müller, Weiden (DE)

(73) Assignee: Hueck Folien GmbH & Co. KG, Pirk (DE)

( * ) Notice: Subject to any disclaimer, the term of this patent is extended or adjusted under 35 U.S.C. 154(b) by 16 days.

(21) Appl. No.: 10/218,038

(22) Filed: Aug. 14, 2002

(65) Prior Publication Data

US 2003/0049423 A1 Mar. 13, 2003

(30) Foreign Application Priority Data

Aug. 14, 2001 (DE) ..... 201 13 491

(51) Int. Cl.[7] ..... A47G 1/12

(52) U.S. Cl. ..... 428/13; 428/203; 428/474.4; 428/480; 428/537.5

(58) Field of Search ..... 428/13, 203, 474.4, 428/480, 537.5

(56) References Cited

U.S. PATENT DOCUMENTS

| | | | | | |
|---|---|---|---|---|---|
| 4,170,681 | A | * | 10/1979 | Edwards et al. | 428/205 |
| 4,253,580 | A | * | 3/1981 | Doi et al. | 215/228 |
| 4,757,940 | A | * | 7/1988 | Quick et al. | 229/3.5 R |
| 5,156,329 | A | * | 10/1992 | Farrell | 229/125.35 |
| 5,228,272 | A | * | 7/1993 | Calvert et al. | 53/477 |
| 5,356,070 | A | * | 10/1994 | Rigby | 229/120.17 |
| 5,500,253 | A | * | 3/1996 | Sanduja et al. | 427/385.5 |
| 5,653,844 | A | * | 8/1997 | Abrams | 156/277 |
| 5,656,362 | A | * | 8/1997 | Abrams | 428/200 |
| 6,199,688 | B1 | * | 3/2001 | Focke | 206/268 |

FOREIGN PATENT DOCUMENTS

| | | |
|---|---|---|
| DE | 299 03 364 | 9/1999 |
| EP | 0 488 452 | 3/1992 |

OTHER PUBLICATIONS

Patent Abstracts of Japan "Easily Bondable Polyester Film" Publication No. 03281636 A;, Publication Date Mar. 30, 1990, Inventor Saeki Koichiro et al.

Patent Abstracts of Japan "Water–Base Printing Ink" Publication No. 06001939 A; Publication Date Jan. 11, 1994, Inventor: Yasuda Hideki et al.

Patent Abstracts of Japan "Cap Seal Material and Method for Cap–Sealing" Publication No. 11147560 A; Publication Date Jun. 02, 1999, Inventor Shinohara Takeshi.

* cited by examiner

*Primary Examiner*—B. Shewareged
(74) *Attorney, Agent, or Firm*—Browdy and Neimark, P.L.L.C.

(57) ABSTRACT

In a printed web-type material, in particular a lid for a container for dairy products, comprising a film of plastics, paper or metal on the visible surface, it is provided, with a view to embodying a material which can be equipped and worked using any hot-sealing varnishes, and more generally to obtaining temperature stability in the printed web of material, that a thermoplastic primer, which is needed for applying the overprint, and the printing ink itself are covered by a varnish of identical or similar composition so that part of the curing agent, which is available in the varnish or applied separately, migrates into the printing ink and the thermoplastic primer, resulting in cross-linking.

10 Claims, No Drawings

PRINTED WEB-TYPE MATERIAL

BACKGROUND OF THE INVENTION

1. Field of the Invention

The invention relates to a printed web-type material, in particular a lid for a container for dairy products, comprising a film of plastics, paper or metal on the visible surface.

2. Background Art

Producing the overprint on lids of the generic type conventionally takes place by flexo or gravure printing. These printing methods are of poor efficiency in the manufacture of minor orders. Any need for identity of quality of the closing film or lid with the final product that will be commercialized, for instance for fairs or internal product presentation, will require investments in costly impression cylinders and machine setting. Alternatively, samples have to be prepared using other printing methods, which will however not be comparable to the originals made on a printing machine. If modifications become necessary after such a product presentation and impression cylinders have already been made, modified impression cylinders have to be prepared anew, which is also rather costly.

In this regard, U.S. patent application Ser. No. 09/512,066 teaches to arrange the digital-printer-made overprint between two layers, one of them being a low-temperature hot-sealing varnish layer. Using a digital printer meets the requirements which rival per se: lids of the generic type are customarily sealed at temperatures ranging between 180° C. and 250° C., whereas the digital printing inks currently available are stable only up to 100° C. and the usual hot-sealing varnishes really start sealing at 160° C. The prior art method of embedding the digital printing inks in between two layers helps protect the printing inks, and using a low-temperature hot-sealing varnish layer prevents them from being damaged by elevated temperatures.

The lack of temperature resistance of the printing inks may give rise to problems also for applications of a different kind, for example when decoration films are applied to chipboards by means of hot-melt adhesives as for instance in the field of furniture making.

SUMMARY OF THE INVENTION

It is an object of the invention, while keeping the advantages of the prior art arrangement, to embody a printed material, in particular a lid, which can be equipped and worked using any hot-sealing varnishes, and more generally to obtain temperature stability in a printed web of material.

According to the invention, this object is attained in that a thermoplastic primer, which is needed for applying of the overprint, and the printing ink itself are covered by a varnish of identical or similar composition so that part of the curing agent, which is applied separately or is available in the varnish, migrates into the printing ink or the thermoplastic primer, resulting in cross-linking.

In this way, a per se thermoplastic system of a softening temperature of approximately 90° C. will pass into a heat-resistant system of a temperature resistance of approximately 280° C. The corresponding reaction is time-dependent and terminated after approximately four days at ambient temperature. Due to the heat resistance thus obtained, it is possible to use any conventional hot-sealing varnishes for closing a container by means of a lid of the generic type or to ensure further workability by means of a hot-melt adhesive.

Preferably it is provided that the termoplastic primer or the varnish is an ethylene acrylate copolymer dispersion or a blend thereof with polyester, PVAC or polyamide.

Favorably, a polyfunctional aziridine can be used as a curing agent.

The cross-linked product according to the invention is in particular a polycondensate.

The embodiment according to the invention is suitable in particular in combination with a digital overprint that is produced by electrostatically generated image buildup, proceeding from a liquid thermoplastic toner and by transfer onto an intermediate. This means that there is no direct contact to the material to be printed, which is why even aluminum foil can be printed.

Such a printing method is also termed indigo printing. In addition to the color pigments, the printing inks used contain charge molecules which can be aligned in the electric field. For printing, a photosensitive coating is charged electrostatically to approximately 800 V and then laser-irradiated. The electric charge drops to approximately 100 V at the exposed spots. This is where the color particles of the printing ink accumulate in the case of full-face coloring of the coating. The non-exposed spots do not accept any color because the charge is too high. The image thus printed is transferred onto an intermediate, a so-called blanket. The blanket temperature is approximately 130° C. This is where the flotation oil contained in the ink evaporates, and the entire printed image polymerizes into a thermoplastic layer. This layer can be transferred onto paper without a primer, transfer onto aluminum foils or the like is possible only by using a primer with which to equip the web-type material. The softening point of the primer must be distinctly below the blanket temperature of 130° C. Another important property of the primer is a high hot tack which confers sufficient adhesion to the material to be printed as well as to the layer of printing ink, ensuring impeccable transfer.

By alternative, printing may take place using liquid ink and a print head or by means of a solid thermoplastic toner.

DESCRIPTION OF THE PREFERRED EMBODIMENT

In keeping with a preferred embodiment, a lid according to the invention has the following structure:

An aluminum foil of a thickness<10 $\mu$m constitutes the basis;

a one-component primer of 0.3 to 0.6 g/m$^2$ is provided as an ethylene acrylate copolymer dispersion;

a digital overprint is produced by indigo printing;

a two-component varnish of 0.8 to 1.5 g/m$^2$ is applied on the top side in the form of an ethylene acrylate copolymer dispersion.

The mentioned layers have terminal OH groups, it being possible to regulate the degree of cross-linking by influencing the OH groups. The printing ink used is thermoplastic, but is applied out of the solution and not out of the melt. The polycondensation cross-linking obtained according to the invention helps ensure that the printed image is not damaged when worked by a conventional sealing instrument at the customarily elevated sealing temperature.

What is claimed is:

1. A printed web-type material, in particular a lid for a container for dairy products, comprising a film of plastics, paper or metal having a visible surface, wherein a thermoplastic polymer primer, which is needed for applying an overprint, and a polymer-containing printing ink forming said overprint are covered by a varnish comprising a polymer which is identical or similar to at least one of the printing ink polymer and the thermoplastic primer polymer, so that part of a curing agent, which is available in the varnish or applied separately, migrates into the printing ink and the thermoplastic primer, resulting in cross-linking.

2. A printed web-type material according to claim 1, wherein at least one of the thermoplastic of the primer and the polymer of the varnish is an ethylene acrylate copolymer dispersion or a blend thereof with polyester, polyvinyl acetate (PVAC) or polyamide.

3. A printed web-type material according to claim 1, wherein the curing agent is a polyfunctional aziridine.

4. A printed web-type material according to claim 1, wherein the crosslinked product is a polycondensate.

5. A printed web-type material according to claim 1, wherein the overprint is a digital print.

6. A printed web-type material according to claim 5, wherein the digital print is produced electrostatically via an intermediate, proceeding from a liquid thermoplastic toner.

7. The printed web-type material of claim 1, wherein the curing agent is in the varnish, and the polymer of the varnish is similar or identical to the polymer of the primer.

8. The printed web-type material of claim 1, wherein the thermoplastic of said varnish is identical or similar to the thermoplastic of said primer.

9. A printed web-type material, in particular a lid for a container, comprising a substrate in the form of a film of plastic, paper or metal, a thermoplastic polymer primer having an initial softening point of up to about 90° C., applied to said substrate, a print applied over said thermoplastic polymer primer, said print comprising a printing ink comprising a thermoplastic polymer, a varnish applied over said print, said varnish comprising a thermoplastic material having a composition identical or similar to at least one of said thermoplastic polymer of said printing ink and said thermoplastic polymer of said primer, and a curing agent either initially within said varnish or initially applied as a separate layer in a position where said curing agent is capable of migrating into the printing ink and the thermoplastic polymer primer, resulting in cross-linking of said thermoplastic polymer of said primer or said thermoplastic polymer of said printing ink.

10. The printed web-type material of claim 9, wherein the curing agent has already migrated into the printing ink and thermoplastic primer, and the thermoplastic polymer of at least one of said primer and said printing ink has become cross-linked whereby said thermoplastic has achieved a temperature resistance of at least approximately 280° C.

* * * * *